US005611488A

United States Patent [19]

Frölich

[11] Patent Number: 5,611,488

[45] Date of Patent: Mar. 18, 1997

[54] SPRINKLER, PARTICULARLY FOR WATERING VEGETATION

[75] Inventor: Hans Frölich, Bernstadt, Germany

[73] Assignee: Gardena Kress & Kastner GmbH, Ulm, Germany

[21] Appl. No.: 294,309

[22] Filed: Aug. 23, 1994

[30] Foreign Application Priority Data

Sep. 2, 1993 [DE] Germany ..... 43 29 616.5

[51] Int. Cl.[6] ..... B05B 3/16

[52] U.S. Cl. ..... 239/242

[58] Field of Search ..... 239/240–242, 239/DIG. 1

[56] References Cited

U.S. PATENT DOCUMENTS

| | | | |
|---|---|---|---|
| 965,941 | 8/1910 | Robertson . | |
| 4,417,691 | 11/1983 | Lockwood | 239/DIG. 1 X |
| 4,613,077 | 9/1986 | Aronson | 239/DIG. 1 X |
| 4,760,958 | 8/1988 | Greenberg . | |
| 4,819,875 | 4/1989 | Beal | 239/DIG. 1 X |
| 4,867,379 | 9/1989 | Hunter . | |
| 4,892,252 | 1/1990 | Bruninga . | |
| 5,052,621 | 10/1991 | Katzer et al. . | |
| 5,086,977 | 2/1992 | Kah, Jr. . | |
| 5,213,016 | 5/1993 | Kah, Jr. . | |
| 5,226,599 | 7/1993 | Lindermeir et al. . | |

FOREIGN PATENT DOCUMENTS

| | | |
|---|---|---|
| 362559 | 4/1990 | European Pat. Off. . |
| 392712 | 10/1990 | European Pat. Off. . |
| 410198 | 1/1991 | European Pat. Off. . |
| 2412748 | 12/1975 | Germany . |
| 3442496 | 6/1985 | Germany . |
| 3730192 | 7/1988 | Germany . |
| 3833984 | 4/1990 | Germany . |
| 1214230 | 2/1986 | U.S.S.R. . |
| 2048121 | 12/1980 | United Kingdom . |

*Primary Examiner*—Kevin Weldon
*Attorney, Agent, or Firm*—Quarles & Brady

[57] ABSTRACT

A sprinkler (1) has flow control means (10) for producing different flow behaviour during forward and return motion of its sprinkler head (2), so that during forward motion there is a far-extending concentrated jet and during the return motion a spray jet watering the near area and discharged by the same nozzle outlet (11),

11 Claims, 2 Drawing Sheets

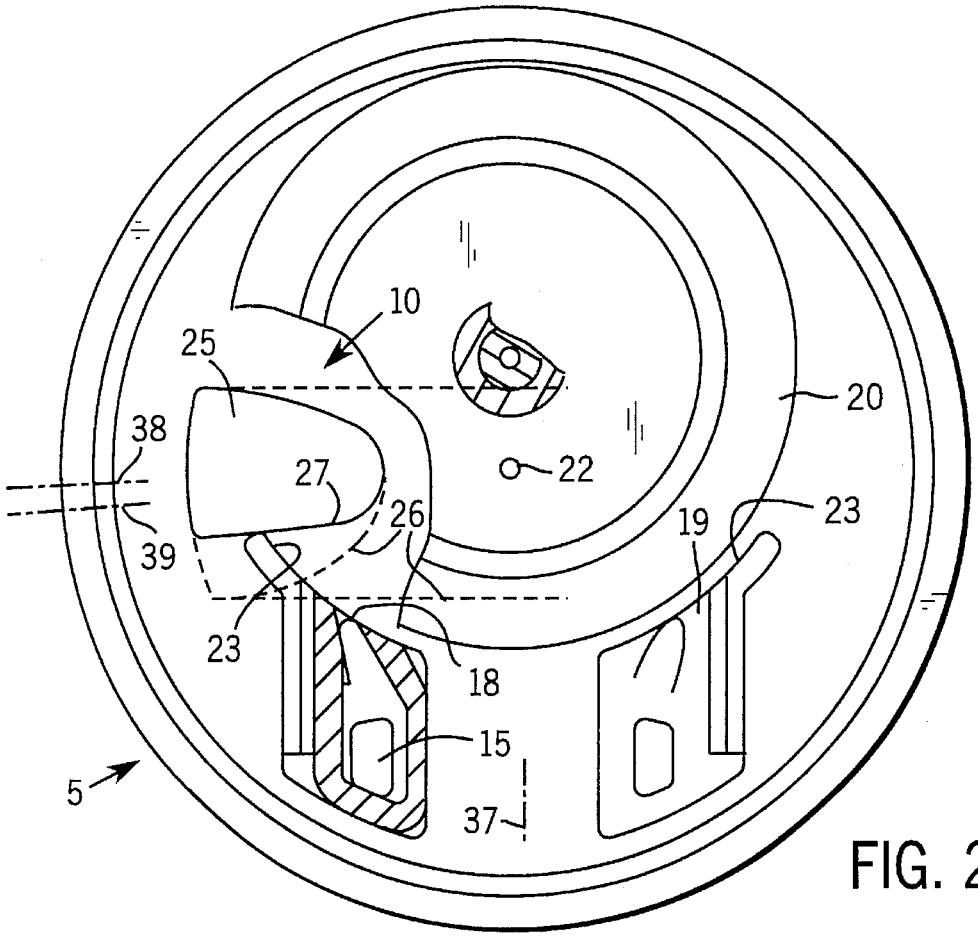
FIG. 2
FIG. 3
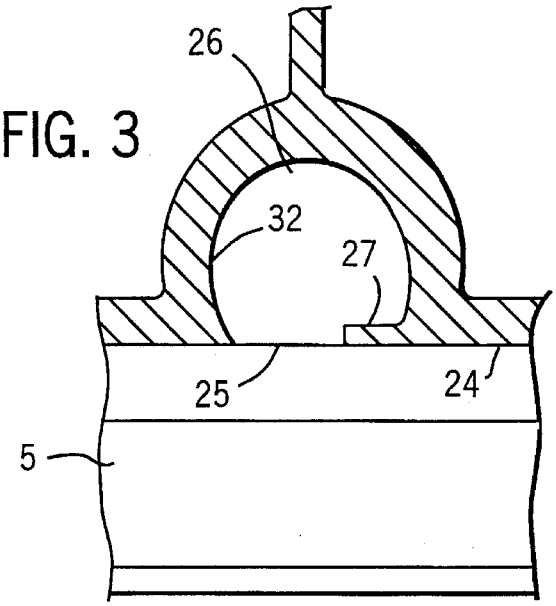

SPRINKLER, PARTICULARLY FOR WATERING VEGETATION

BACKGROUND OF THE INVENTION

The invention relates to a sprinkler or similar subassembly for discharging fluid, with which the fluid, usually water, can be discharged over a relatively long distance of e.g. several meters from the sprinkler head or outlet, so that it covers a predetermined sprinkling or watering field, which is usually positioned roughly horizontally or by a horizontal position forms a measurement base. For this purpose, the water is discharged under pressure from the sprinkler outlet over a free jet path, usually a parabolic projection path, and from the outlet, there is no further contact with or direct guidance of the fluid jet by the sprinkler.

For watering vegetation, it is possible to use sprinklers with a fixed outlet during operation, or those in which the fluid jet is given a transverse movement directed at right angles to its longitudinal direction e.g. in that the sprinkler head performs a movement roughly parallel or at right angles to the sprinkling field, such as a continuous unidirected and/or a reciprocating rotary or axial movement. In order to discharge the fluid jet as far as possible, as compared with an approximately horizontal or approximately vertically upwardly or downwardly directed orientations of the outlet, preference is given to an upwardly sloping orientation under an angle of approximately 30° to 45°. For example, by means of a rod-like or upwardly extendable construction of the sprinkler head, it is possible to obtain a relatively high position of the outlet with respect to or over the sprinkling field. Such a sprinkler is e.g. described in European patent application 410,198 or European patent application 362,559, to which reference is made in the present invention for incorporating their features and actions.

If it is intended to discharge the fluid jet, with a supply pressure given by a restrictor or the pressure in the water mains, over a considerable distance of e.g. more than 3, 5 or 10 meters, then the shape of the nozzle outlet and the fluid paths leading thereto or the channel portions of the fluid guide are appropriately chosen in such a way that a linear, calm flow is supplied to the nozzle outlet and the fluid jet leaves the nozzle outlet as a so-called concentrated jet, which leaves-the fluid outlet in closely bundled, focused or concentrated form without any significant spraying and remains in this way for several meters. This concentrated jet only fans out at a considerable distance from the fluid outlet and waters a sprinkling field of predetermined surface size with an average watering density per surface unit, which is appropriately substantially constant over the sprinkling field.

Between the sprinkling field and the sprinkler, there is usually no significant sprinkling or watering, so that in said near field, the sprinkling density is much lower than in the true sprinkling field. This can admittedly be counter-acted by a corresponding, e.g. asymmetrical design of the sprinkler outlet, but there is then a reduced maximum range of the fluid or concentrated jet, because part of the fluid jet is branched off as a spray jet for the near area.

Much the same occurs if the outlet or the point of final contact of the fluid jet with the sprinkler is formed by a jet disturbance member, which is rhythmically moved into the concentrated jet and consequently on each occasion brings about a spraying action for the near area. The short spray pulses are generally not sufficient to water, in the same way as the concentrated jet sprinkling field, the near area or the field between the sprinkling field of the concentrated jet and the sprinkler with roughly the same watering density. Even if the concentrated jet or the sprinkler outlet is moved from one inoperative position to the next by a jerky transverse movement, admittedly said pulse movement slightly reduces the range of the fluid jet, but not in such a way that the near area is appropriately watered.

OBJECTS OF THE INVENTION

An object of the invention is to provide a sprinkler avoiding the disadvantages of known constructions or of the described type and which in particular, with a considerable range, ensures a size-increased sprinkling field e.g. in the direction of its Jet axis towards the sprinkler with a roughly uniform sprinkling density over the extension thereof, and which in a view from above, also allows a watering up to a few meters or less than one meter from the sprinkler, or directly up to the sprinkler outlet. In addition, the sprinkler should be reliable in operation or should be less susceptible to disturbances or problems and in the vicinity of the sprinkler outlet should have no parts or control members performing movements during operation.

SUMMARY OF THE INVENTION

According to the invention, means are provided to so influence or divert the fluid with respect to a flow within the sprinkler head or in the flow direction upstream of the outlet that it leaves the sprinkler in widely differing jet shapes or with widely differing ranges. The different jet shapes are supplied by the sprinkler in an at least partly time-succeeding manner, e.g. following onto one another directly without any discharge interruption or with a slight overlap in such a way that the discharge of the following jet shape commences a short time before the end of the discharge of the preceding jet shape. It is conceivable to provide more than two different jet shapes and appropriately the two sprinkling fields of in each case two different jet shapes are substantially adjacent to one another or slightly overlap one another, so that a continuous watering action is obtained.

It is conceivable to bring about at least two different jet shapes by alternating discharge from separate nozzles or nozzle apertures, which are correspondingly differently constructed, e.g. as a concentrated jet nozzle and as a spray nozzle. In addition, different jet shapes can be brought about by transverse movements at widely differing speeds, but in the case of a transverse movement roughly parallel to the sprinkling field, roughly the same sprinkling sector is firstly subject to a higher speed action and then to a lower speed action, so that in the case of the higher speed the near area and at the lower speed the more remote area of the same sector is watered.

It is particularly appropriate if at least two different jet shapes alternately follow one another and are discharged through the same outlet without any discharge interruption or reduction and which is appropriately constructed in such a way that it can discharge a concentrated jet. If, in the flow direction upstream of the outlet, the flow is correspondingly influenced, e.g. compared with the discharge as a concentrated jet, is less calmed or more turbulent, then said flow influencing leads to the water leaving the outlet in a much more sprayed form as compared with a concentrated jet, so that its range is correspondingly reduced and it acts on the near area.

Compared with a random switching or changing between the jet shapes, preference is given to an automatic switching or changing action, and then in place of a manually operable switching drive, there is appropriately a drive which runs along during the operation of the sprinkler and switches over after predetermined time or distance intervals. The motive energy is appropriately taken from the fluid flowing through the sprinkler, the drive itself influencing in alternately differing ways the said flow. As a function of requirements, the fluid discharge volume supplied per time unit can be roughly the same or different during operation with separate jet shapes, e.g. in such a way that the smaller discharge volume is at least ½ or ¾ of the larger discharge volume and is provided for the larger or smaller range.

The influencing of the flow can be brought about by numerous different measures, which can in each case be provided individually or in combination. For example, it is possible to provide a flow disturbance member, which can be automatically transferred into different functional positions during operation and/or which is manually adjustable or settable and which in one position allows a relatively linear, calm flow up to the outlet and in at least one further position brings about a turbulent action with respect to said flow up to the outlet. It is also possible to provide separate fluid paths, which differently influence the flow in the described manner and through which there is alternately a stronger or weaker flow or which can be at least partly blocked or opened. Separate flow paths can be formed by separate channel portions or a common channel portion or a chamber, in which the flow is alternately guided in different directions or over varyingly long paths, e.g. by deflectors.

It is also possible in one channel or duct portion to guide the water for one jet shape in a flow roller rotating about the channel axis, whereas for the other jet shape it rotates less strongly or not at all and reaches the outlet with a corresponding flow behaviour. It is also possible, for an alternate flow in different directions against a non-axially symmetrical inlet of a channel portion connected to a chamber and which is much narrower than the latter and for each inflow direction, there is a different flow behaviour of the water in said channel portion and the water is then guided with this flow behaviour up to the outlet. In addition, deflectors can be moved by the water force or form wide chambers, in which the water is moved along e.g. in a rotary movement over more than 90, 180 or approximately 270 radians.

Moreover, in the fluid guide can be provided a restrictor switchable in the described manner between different restriction actions through which the flow volume or fluid pressure at the outlet is modified. The sprinkler forms a closed subassembly, which is to be connected with an inlet to a fluid source, particularly a pressure source appropriately provided in fixed manner on a body, said control means being appropriately provided in the flow direction following the said inlet or in the vicinity of the inlet.

It is particularly appropriate if the fluid flow path between the control means or members influencing the flow and the outlet are as small as possible or smaller than the corresponding distance from the inlet. For example, control means in the vicinity of the inlet of an end channel guided over most of the longitudinal extension thereof in approximately linear manner up to the outlet or inlet of a nozzle or nozzle insert and with respect to which the width of the inlet or outlet is reduced. The end channel inlet can be connected to a chamber with a larger volume or much wider than the same in which the flow is calmed, made turbulent, passed in different directions and over varyingly long paths. The inlet of the end channel or the leading-away channel portion can in the same way as at least one control member directly influencing the flow be positioned roughly in the plane of a boundary wall of the chamber, preference being given to a position in an end wall compared with a position in a surface or circumferential wall. It is also advantageous if the passage cross-section of said inlet is reduced compared with that of the remaining end channel in the manner of a restriction point and if the end channel has approximately constant passage cross-sections up to the nozzle inlet and instead of being annular is freely open from a channel core over its entire cross-section up to its central axis. The flow cross-section of the end channel inlet is appropriately larger than that of the sprinkler outlet.

BRIEF FIGURE DESCRIPTION

These and further features can be gathered from the claims, description and drawings and the individual features, either singly or in the form of subcombinations, can be realized in an embodiment of the invention and in other fields and can represent advantageous, independently protectable constructions for which protection is hereby claimed. An embodiment of the invention is shown in the drawings and is explained hereinafter relative thereto, wherein show:

FIG. 1 a detail of a sprinkler according to the invention in a partly exploded view.

FIG. 2 a view of the inside of the nozzle head of the sprinkler of FIG. 1.

FIG. 3 a cross-section through the inlet of the nozzle head of FIG. 1.

DETAILED DESCRIPTION OF PREFERRED EXAMPLE EMBODIMENTS

Figure 1:
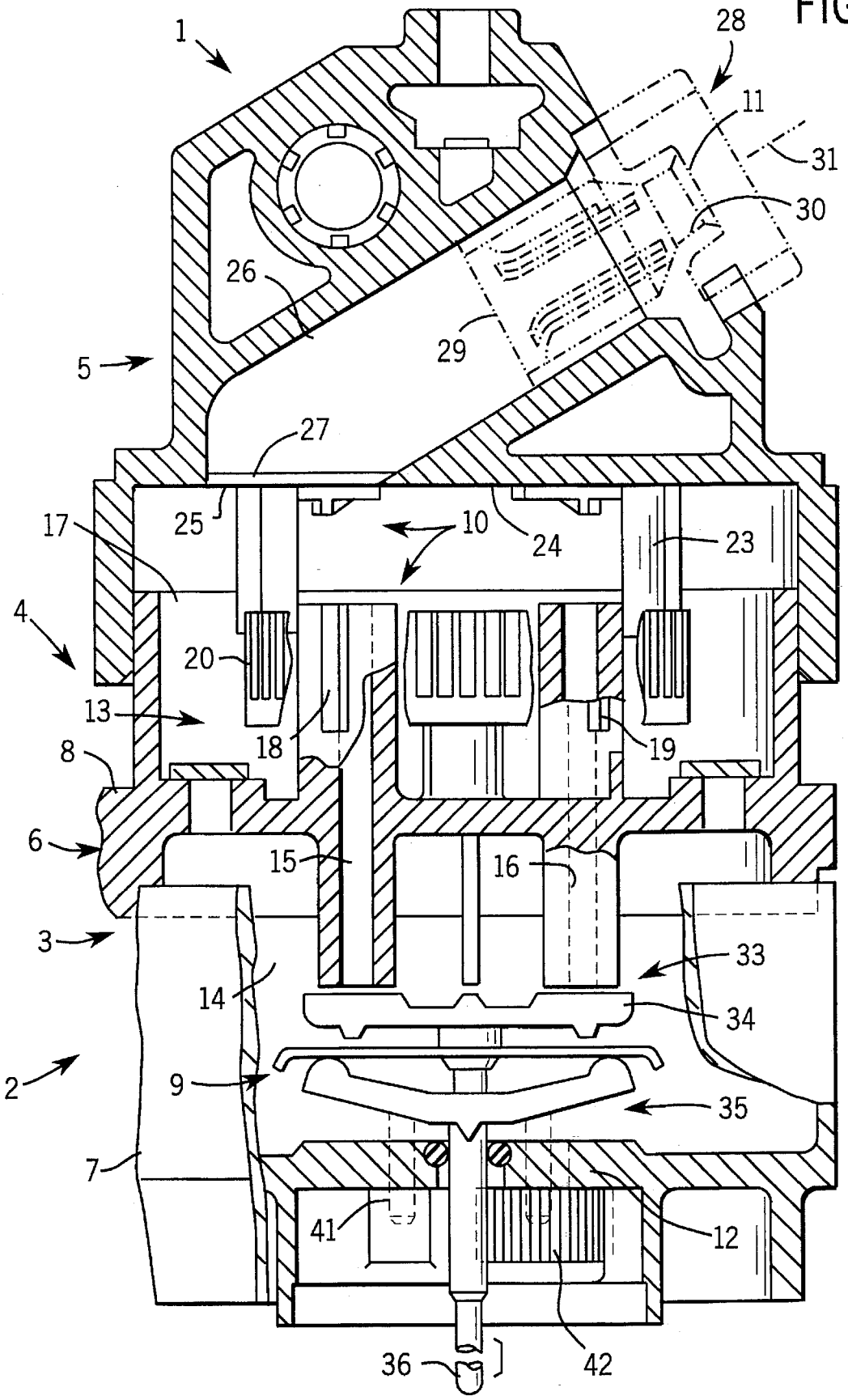

The sprinkler 1 constructed as a sector sprinkler has a sprinkler head 2 shown in FIG. 1, whose sprinkler nozzle passes through rotation ranges in controlled forward and return motion, the rotation ranges being adjustable continuously between approximately 20° and 360°. For the continuously reversing rotary movement a fluid drive 3 is provided in the body 4 of the sprinkler head 2 and is located in a drive casing 6 separate from the nozzle head 5, the latter and the drive casing 6 forming the body 4 of the sprinkler head 2. The drive casing 6 is constituted by two axially assembled casing parts 7,8, and on one casing part 8, the casing-like nozzle head 5 is so axially mounted with a cap or jacket portion that its outer circumference forms an approximately continuous extension of the outer circumferences of the casing parts 7,8. For reversing the drive direction of the drive 3, a reversing control 9 is provided, which in path or distance-dependent manner, or at the end of a rotation path, reverses the rotation direction by mechanical stop action. The body 4 or casing 5,6 together with the drive 3 guide the rotary movement with respect to a shaft, which is connected to the lower end of the casing part 7 with roughly its outside diameter and which has a tread for the engagement of an output rotor of the drive 3.

For modifying the jet shape of the watering jet passing out of the sprinkler 1 is provided a control device 10 with a plurality of control members 11, 13 to 20, 23 to 30 and 32 to 36, which either form fixed control members or such members which move during operation. The outlet 11 sloping upwards under an angle of approximately 60° compared with the roughly vertically oriented or parallel central axes of the body 4 and the drive 3 is in the top region of the sprinkler head 2 or nozzle head 5 close to the approximately cylindrical envelope of the body 4. The water inlet 12 is at the lower end of the body 4 or can be formed by a connecting piece on a socket or base, which receives in rotary manner the sprinkler head 2 and is optionally formed by the shaft, in which the sprinkler head 2 is to be countersunk with its top approximately flush in a non-operating position or by water pressure can again be extended upwards transversely to the axis of the outlet 11.

Between the inlet 12 and the outlet 11, the casing parts of the body 4 form a fluid guide 13 constituted by numerous portions or channel portions or chambers by means of which the drive 3 is operated. To the inlet 12, provided in a lower end wall of the casing part 7 and e.g. formed by a hollow shaft of the base receiving in rotary manner the sprinkler head 2, is connected a control chamber 14 laterally displaced with respect to the central axis of the sprinkler head 2, which is bounded by the two casing parts 7,8 and receives the reversing control 9. An upper end wall of the control chamber 14 formed by the casing part 8 is traversed by two upright channel portions 15,16, which in each case, project on either side past said end wall in the manner of pipe connections, so that their lower ends are connected to the control chamber 14.

The upper ends of the closely adjacent channel portions 15,16 issue into a control chamber 17 connected to the other side of said end wall of the casing part 8, and which with the exception of wall thicknesses, has roughly the same width as the casing parts 5,8 and is bounded by these. Into said control chamber 17 issue the two channel portions 15,16 in each case with a slot-like fluid nozzle 18,19 located in the longitudinal direction thereof, the discharge direction of the fluid nozzles 18,19 being directed under an acute angle of approximately 40° away from one another against the inner circumference of the control chamber 17. The fluid nozzles 18,19 roughly parallel to the central axis of the control chamber 17 are positioned symmetrically on either side of an axial plane of the chamber 17 and are set back with respect to the axial plane at right angles thereto with respect to the inner circumference of the control chamber 17. In cross-section according to FIG. 2 the central axes of the fluid nozzles 18,19 on the inner circumference of the control chamber 17 are at an arc distance of 90° or more from one another with respect to said central axis.

In the control chamber 17 is mounted a control rotor 20 rotatable about a rotor axis which is parallel, but eccentric to the central axis 22 of the control chamber 17 or body 4 and whose outer circumference is immediately adjacent to the fluid nozzles 18,19, so that it approximately covers these. The relatively wide cup casing of the approximately cup-shaped control rotor 20 is formed by a roughly radially oriented and spaced following guide or blade webs between which can directly enter the water passing out of the fluid nozzles 18,19. On the inner circumference the gaps are closed by a casing, which is also closed on its bottom located closer to the casing part 7. The rotor axis 21 on the one hand and the fluid nozzles 18,19 on the other are provided in spaced manner on either side of the axial plane of the control chamber 17 which is at right angles to the common axial plane of the control chamber 17 and the control rotor 20 located between the fluid nozzles 18,19. The outer circumference of the control rotor 20 which is much smaller than the inner circumference of the control chamber 17 extends at one point to close to its inner circumference. From the inside of the upper end wall of the casing part 5 project web-like guide members or faces 23, which laterally on the remote sides of the fluid nozzles 18,19 surround the outer circumference of the control rotor 20 only with a gap spacing over a small arc angle and are directed away from one another in said circumferential direction. As a result of the guide faces the water passing out of the fluid nozzles 18,19 is forced between the blade webs of the control rotor 20 and after this it can freely pass into the control chamber 17 and out against its inner circumference.

In said end wall 24 of the casing part 5 or traversing the same is circumferentially provided an inlet 25 circumferentially about the axes 21,22 and immediately adjacent to the fluid nozzle 18 or to the associated guide face 23 and at right angles to the central axis 22 it has a roughly half greater extension than in the circumferential direction about the central axis 22. The inlet 25 which has a smaller distance from the inner circumference of the control chamber 17 than from the outer circumference of the control rotor 20 in the associated area, in the view according to FIG. 2 is only covered on its larger, radially inward part of its longitudinal extension by the rotor 20, but with its outer, widest part is free and tapers by a concave and radially inwardly progressively curved boundary in the direction of the central axis 22, from which it has a greater spacing than from the inner circumference of the control chamber 17. The inlet 25 forms the in flow direction rear end of an end channel 26 of the nozzle head 5 leading directly to the outlet 11 and is in an acute-angled plane of approximately 30° to 45° to the central axis of said end channel 26, so that the inner circumference of the end channel 26 is connected in directly acute-angled manner to the narrower end of the inlet 25 adjacent to the central axis 22, whereas the inner circumference of the end channel 26 is connected to the opposite end of the inlet 25 approximately at right angles to its end.

In the view according to FIG. 2 the end channel 26 is wider than the inlet 25, but is connected approximately tangentially at the side of the inlet 25 remote from the fluid nozzle 18, so that on its side closer to the fluid nozzle 18 it projects in its radial direction over the inlet 25. In this area the end channel 26 is separated from the control chamber 17 by a thin control web 27, which forms the associated, approximately linear longitudinal boundary 27 of the inlet 25 directed away from the fluid nozzle 18 and up to which approximately extends the associated guide face or deflector 23. The lower outer face of the control web 27 is roughly in the plane of the inside of the end wall 24, which also has closure members, with which the upper ends of the channel portions 15,16 are closed in such a way that only the fluid nozzles 18,19 leading away from their circumferences are open. The upper end face of the control rotor 20 extends with a small gap spacing virtually up to the end wall 24. The channel is roughly diametrical to the axis 22, so that the outlet 11 and the inlet 25 are axially reciprocally displaced on remote sides of the axis 22.

The outlet 11 is formed by a nozzle or by a nozzle insert which can be inserted in easy interchangeable manner into the nozzle head and which projects with a sleeve in closely engaging manner in the end channel 26 and within the latter forms the nozzle inlet 29. The distance between the nozzle inlet 29 and the control member 27 or inlet 25 at an acute angle thereto is smaller than three times or twice the inside diameter of the end channel 26 with respect to which the inside diameter of the inlet 29 is only slightly reduced. From the nozzle inlet 29 extends with essentially the same width in the flow direction an inlet channel up to a significantly constricted, shorter and cylindrical nozzle channel 30, into which passes the inlet channel by means of a frustum-shaped portion and whose length is at the most as large as its width or is smaller than the latter.

At the outer end and over a smaller part of its length the end channel 30 can be widened in funnel-shaped manner, said widening forming at a free end face the sprinkler outlet 11, which is surrounded by a relatively narrow, annular tear-off edge for the jet. The outlet 11 can be surrounded in radial spacing and in annular manner by a wider and further forward projecting jacket, whose free end is contacted on the inner circumference by the water jet passing out of the outlet 11, provided that it is fanned out roughly under the cone angle of the outlet 11 and is consequently discharged as a spray jet. Within the inlet channel it is possible to provide circumferentially distributed longitudinal ribs for calming or stabilizing the flow, but which leave free a central zone, which is at least as wide or wider than the end channel 30. The outlet 11, end channel 26, nozzle inlet 29 and nozzle channel 30 are appropriately coaxial to one another in the axis 31 of the nozzle inlet 28, which only forms a single channel portion for the fluid. The distance between the inlet 29 and the outlet 11 is approximately the same as the residual length of the channel 26.

The median or axial plane of the axes 21,22 located between the fluid nozzles 18,19 is designated 37 and the axial plane of the central axis 22 at right angles thereto is designated 38 and passes roughly through the centre of the width of the inlet 25. An axial plane 39 of the central axis 22 roughly parallel to the boundary edge of the control web 27 is displaced relative to the axial plane 38 to the fluid nozzle 18 by an angle of a few degrees. The distance from the fluid nozzle 18 to the inlet 25 is roughly the same as or smaller than its width, said fluid nozzle 18 bringing about a rotation direction of the control rotor 20, which is directed from the fluid nozzle 18 directly over the shortest path to the inlet 25. The other fluid nozzle 19 brings about an opposite rotation direction of the control rotor 20, so that the water passing out of it must be entrained over most of the circumference of the rotor 20 until it reaches the boundary of the inlet 25 opposite to the control member 27. The control member 29 covers part of the passage cross-section of the channel 26 with respect to the chamber 17 and the inlet 25 eccentric to the axes 21,22 is laterally adjacent to the central axis 37.

Over most of its length the end channel 26 is cylindrical, but has as a result of its inclined position in the vicinity of the inlet 25 cross-sections at right angles thereto diverging from the circular shape and which are, approximately oval, but the oval apex belonging to the inlet 25 in the plane of the inside of the end wall 24 is cut off roughly to ⅓ of the oval height. Thus, the inner circumference or channel wall 32 of the end channel 26 on the side opposite to the control member 27 as the associated boundary of the inlet 25, in cross-section under an acute angle is adjacent to the plane of the inlet 25, so that the channel wall 32 passes out in concave curved manner from this area and the boundary of the inlet 25 opposite to the control member 27 is cross-sectionally bounded by flanks which are at an acute angle to one another. Correspondingly the channel wall 32 passes out from the associated inside of the control web 27.

If in the case of a blocked fluid nozzle 19 the water passes out of the fluid nozzle 18, then it passes with the control rotor 20 on the shortest path along the underside of the control member 27 into the vicinity of the inlet 25 and flows against the boundary of the inlet 25 opposite to the control member 27, is transferred along the channel wall 32 into a roller flow continuing in the end channel 26 and is so deflected on the inside of the control member 27 that it cannot pass again through the inlet 25 back into the control chamber 17 and instead once again flows against the opposite area of the channel wall 32. However, if water passes out of the fluid nozzle 19 with the fluid nozzle 18 blocked, then it initially drives the rotor 20, but then comes free from the deflector 23, so that it can freely flow into the control chamber 17, where its flow can be stabilized. The water then flows against the area of the inner circumference of the completely filled control chamber 17 located in the extension of the deflector 23 and passes in stabilized form into the inlet 25, so that it passes with a substantially linear flow behaviour into the nozzle inlet 29 and is discharged as a concentrated jet with a diameter corresponding to the width of the nozzle channel 30.

However, on producing the roller or turbulent flow, it passes into the nozzle inlet 29 and continues into the nozzle channel 30, so that when the water enters the widened outlet 11 it is fanned out and discharged as an acute or obtuse-angled, conical spray jet. During operation with the fluid nozzle 19 the water is also conveyed by the rotor 20 over the larger circumferential path to the inlet 25, because the rotor gives a corresponding rotary movement to the water in the control chamber 17. In the case of the associated flow against the inlet 25, the control member 27 is substantially ineffective or its action is such that it brings about little or no turbulent or roller flow. As a result of the two oppositely directed inflow directions in the vicinity of the inlet 25, oppositely directed, rotary roller flows can be produced in the end channel 26, whereof one is e.g. much weaker than the other and can be adequately stabilized or calmed again on the linearization means in the inlet channel of the nozzle 28, so that in the smooth-walled nozzle channel 30 it forms the concentrated jet corresponding to the diameter thereof. In the case of the oppositely directed stronger roller flow, it is maintained in the core of the inlet channel, the core flow in the vicinity of the inlet of the nozzle channel 30 is concentrated with the jacket or surface flow flowing along the longitudinal webs and is consequently additionally whirled up or made turbulent.

For reversing the two fluid nozzles 18,19 is provided a valve 33, which is appropriately located within the control chamber 14 and whose two-armed, rocker-like closing part 34 acts directly on the inlets of the channel portions 15,16 in such a way that it engages in sealing manner against in each case one of the two end faces of the tubular extensions and frees the other inlet to the control chamber 14. The closing part 34 is operated by a valve control 35, which has a rod-shaped actuating member 36 passing out freely downwards through the lower end wall of the control chamber 14. Said member is positioned laterally adjacent to the central axis 22 on the side remote from the axis 21, so that it performs with the body 4 an arc movement corresponding to the rotation angle about the axis 22. The actuating member 36 moves between manually independently adjustable, not shown stops, which are mounted on the base. If the actuating member 36 strikes against a stop, then it is pivoted about an axis inter-secting the axis 22 and its longitudinal axis roughly at right angles by a few radians and by means of a control rocker located within the control chamber 14 takes the closing member out of the preceding control position into the other control position by means of an intermediate spring in such a way that the closing member 34 is resiliently pressed against the associated valve seat and consequently the fluid passage into the control chamber 17 is reversed from one fluid nozzle 18 or 19 to the other. With the said stops it is possible on the one hand to randomly adjust the angular position and on the other the size of the angle of the watering sector.

Essentially all parts of the control device 10 are also suitable for bringing about the drive of the rotary movement of the sprinkler head 2, so that with the exception of a multistage gear no other components are needed. The control rotor 20 serves as the drive rotor for said gear, which has two gear shafts 41 displaced in axially parallel manner with respect to the rotor axis 21 and with alternately engaging gear wheels and is located in a dry gear chamber separate from the fluid guide 13 on the side of the axes 21,22 remote from the control chamber 14 or fluid nozzles 18,19. On the lower end of one of the two gear shafts 41 is provided an output pinion 42, which comes into engagement with the fixed tread of the base by axial assembly of the sprinkler head 2 with said base and consequently rolls on said tread and carries with it the sprinkler head. The valve 33 serves as the reversing valve of the reversing control 9 and by reversing from one fluid nozzle 18,19 to the other the rotation direction of the control rotor 20, the gear and the output pinion 42 is reversed. Therefore the sprinkler head 5 in each case modifies its rotation direction. Thus, on each occasion at the end of each rotary movement or on changing the rotation direction there is also a change from one jet shape to another, so that on a given rotary sector sprinkling firstly takes place in one rotation direction with one jet shape and then in the opposite rotation direction with the other jet shape and optionally on substantially separate fields. All the components, subassemblies and constructions, instead of being provided once, can be provided a number of times with the same or different construction and can be combined into an overall unit.

It is also conceivable to produce the different jet shapes independently of the position of the inlet 25 in such a way that in one of the two rotation directions of the control rotor 20 in the path of the water flow is provided a barrier similar to the nose 27 or other means disturbing the water flow prior to entering the inlet 25, e.g. an adjustable disturbance jet screw, which brings about a turbulence of the water flow in one of the two rotation directions. Another possibility for obtaining different jet shapes consists of driving the control member 20 in the two opposite movement directions with different speeds. This can e.g. be achieved in that the fluid nozzles 18,19 have different passage cross-sections, radial spacings from the control rotor 20 and/or orientations with respect to the control rotor 20. In the case of a higher speed of the control rotor 20 there is a greater turbulence in the water flow in the control chamber 17 than at a lower speed, so that on one occasion a spray jet is produced and on the other a concentrated jet. The setting can be such that the further removed sprinkling field has the same or a smaller surface size to the nearer sprinkling field.

I claim:

1. A sprinkler for irrigation, said sprinkler having an outlet for delivering to an irrigation field at least one fluid jet flowing from a jet beginning at said outlet, said jet traveling a median throw distance from said outlet to a median point in an area of irrigation, said sprinkler comprising:

at least one sprinkler head (2) having a sprinkler head body, a fluid inlet (12) for receiving the fluid from a supply of pressurized fluid at a flow volume per time unit, a fluid outlet (11), and between said fluid inlet (12) and said fluid outlet (11), a fluid guide (13) for guiding at least one fluid flow stream, said fluid flow stream flowing in at least one flow direction, and control means (10) for varying the median throw distance of said jet substantially independently of the supply pressure at said fluid inlet (12), said control means (10) having at least one reversing means (33, 34) upstream of said fluid outlet (11) for cycling back and forth between a first operational position and a second operational position, wherein said control means (10) are provided for modifying the fluid flow upstream of the fluid outlet (11) to vary the median throw distance of said jet, thereby providing at least two different median throw distances, wherein said control means (10) includes means for modifying the fluid flow substantially independently of the fluid volume discharged per time unit from said fluid outlet (11) to switch between the different median throw distances.

2. A sprinkler for irrigation, said sprinkler having an outlet for delivering to an irrigation field at least one fluid jet flowing from a jet beginning at said outlet, said jet traveling a median throw distance from said outlet to a median point in an area of irrigation, said sprinkler comprising:

at least one sprinkler head (2) having a sprinkler head body, a fluid inlet (12) for receiving the fluid from a supply of pressurized fluid at a flow volume per time unit, a fluid outlet (11), and between said fluid inlet (12) and said fluid outlet (11), a fluid guide (13) for guiding at least one fluid flow stream, said fluid flow stream flowing in at least one flow direction, and control means (10) for varying the median throw distance of said jet substantially independently of the supply pressure at said fluid inlet (12), said control means (10) having at least one reversing means (33, 34) upstream of said fluid outlet (11) for cycling back and forth between a first operational position and a second operational position, wherein said control means (10) are provided for modifying the fluid flow upstream of the fluid outlet (11) to vary the median throw distance of said jet, thereby providing at least two different median throw distances, wherein said control means (10) switches between the two different median throw distances by at least one of:

modifying fluid paths for fluid flow (15, 18, 23 or 16, 19, 23) within said fluid guide (13);

modifying a pattern of the fluid flow;

disturbing a flow current within said fluid guide (13); stabilizing a flow current within said fluid guide (13); reversing said flow direction within said fluid guide (13); and modifying a current roll of the fluid flow.

3. A sprinkler for irrigation, said sprinkler having an outlet for delivering to an irrigation field at least one fluid jet flowing from a jet beginning at said outlet, said jet traveling a median throw distance from said outlet to a median point in an area of irrigation, said sprinkler comprising:

at least one sprinkler head (2) having a sprinkler head body, a fluid inlet (12) for receiving the fluid from a supply of pressurized fluid at a flow volume per time unit, a fluid outlet (11), and between said fluid inlet (12) and said fluid outlet (11), a fluid guide (13) for guiding at least one fluid flow stream, said fluid flow stream flowing in at least one flow direction, and control means (10) for varying the median throw distance of said jet substantially independently of the supply pressure at said fluid inlet (12), said control means (10) having at least one reversing means (33, 34) upstream of said fluid outlet (11) for cycling back and forth between a first operational position and a second operational position, wherein said control means (10) are provided for modifying the fluid flow upstream of the fluid outlet (11) to vary the median throw distance of said jet wherein, in a transition between said control means (10) and said end duct (26), said sprinkler includes a connecting duct (26) having a duct inlet end (25), said sprinkler includes at least one flow disturbing member (27) for switching to a shorter one of the at least two median throw distances, said flow disturbing member (27) providing a cross-sectional passage width reduction in relation to the end duct (26) downstream directly connecting to said flow disturbing member (27) with the duct inlet end (25), wherein said duct end (25) is located in an end passage plane and has opposing first and second passage boundaries, said first passage boundary being provided by a projection (27) located substantially in said passage plane and projecting past a circumferential duct wall of said connecting duct (26) towards said second passage boundary.

4. A sprinkler for irrigation, said sprinkler having an outlet for delivering to an irrigation field at least one fluid jet flowing from a jet beginning at said outlet, said jet traveling a median throw distance from said outlet to a median point in an area of irrigation, said sprinkler comprising:

at least one sprinkler head (2) having a sprinkler head body, a fluid inlet (12) for receiving the fluid from a supply of pressurized fluid at a flow volume per time unit, a fluid outlet (11), and between said fluid inlet (12) and said fluid outlet (11), a fluid guide (13) for guiding at least one fluid flow stream, said fluid flow stream flowing in at least one flow direction, and control means (10) for varying the median throw distance of said jet substantially independently of the supply pressure at said fluid inlet (12), said control means (10) having at least one reversing means (33, 34) upstream of said fluid outlet (11) for cycling back and forth between a first operational position and a second operational position, wherein said control means (10) are provided for modifying the fluid flow upstream of the fluid outlet (11) to vary the median throw distance of said jet wherein in parallelism said fluid guide (13) has at least first and second duct sections (15,16), said reversing means (33,34) being provided for alternatingly reducing and increasing the fluid flow through at least one of said duct sections (15,16), said first duct section (15) issuing with a direct nozzle (18) directed substantially against a duct inlet (25) of a connecting duct (26), said second duct section (16) issuing with a diverting nozzle (19) directed substantially not against said duct inlet (25) and against a deflector.

5. The sprinkler according to claim 4, wherein said direct nozzle (18) is provided for guiding the fluid over a first fluid path along a flank of a projection (27) up to a free projection end, said deflector providing a circumferential jacket deflector guiding the fluid discharged from said diverting nozzle (19) over a second fluid path in an arc substantially against said free projection end, said first and second fluid paths being of different length extensions.

6. The sprinkler according to claim 4, wherein at least one of said direct nozzle (18) and said diverting nozzle (19) is oriented substantially parallel to a passage plane, in which said duct inlet (25) is located.

7. A sprinkler for irrigation, said sprinkler having an outlet for delivering to an irrigation field at least one fluid jet flowing from a jet beginning at said outlet, said jet traveling a median throw distance from said outlet to a median point in an area of irrigation, said sprinkler comprising:

at least one sprinkler head (2) having a sprinkler head body, a fluid inlet (12) for receiving the fluid from a supply of pressurized fluid at a flow volume per time unit, a fluid outlet (11), and between said fluid inlet (12) and said fluid outlet (11), a fluid guide (13) for guiding at least one fluid flow stream, said fluid flow stream flowing in at least one flow direction, and control means (10) for varying the median throw distance of said jet substantially independently of the supply pressure at said fluid inlet (12), said control means (10) having at least one reversing means (33, 34) upstream of said fluid outlet (11) for cycling back and forth between a first operational position and a second operational position, wherein said control means (10) are provided for modifying the fluid flow upstream of the fluid outlet (11) to vary the median throw distance of said jet, wherein said reversing means includes a control rotor (20) operating in clockwise and counterclockwise directions each corresponding to a different one of said individual throw distances, said control rotor (20) being at least one of located directly adjacent to a duct inlet (25) of a duct section (26) that is downstream relative to said control rotor (20), and at least partly covering said duct inlet (25).

8. The sprinkler according to claim 7, wherein said sprinkler head includes a current smoothening chamber (17) and said control rotor (20) bounds an asymmetrical annular space bounded by inner and outer bounding jacket faces.

9. A sprinkler for irrigation, said sprinkler having an outlet for delivering to an irrigation field at least one fluid jet flowing from a jet beginning at said outlet, said jet traveling a median throw distance from said outlet to a median point in an area of irrigation, said sprinkler comprising:

at least one sprinkler head (2) having a sprinkler head body, a fluid inlet (12) for receiving the fluid from a supply of pressurized fluid at a flow volume per time unit, a fluid outlet (11), and between said fluid inlet (12) and said fluid outlet (11), a fluid guide (13) for guiding at least one fluid flow stream, said fluid flow stream flowing in at least one flow direction, and control means (10) for varying the median throw distance of said jet substantially independently of the supply pressure at said fluid inlet (12), said control means (10) having at least one reversing means (33,34) upstream of said fluid outlet (11) for cycling back and forth between a first operational position and a second operational position, wherein said control means (10) are provided for modifying the fluid flow upstream of the fluid outlet (11) to vary the median throw distance of said jet, wherein said fluid guide (13) includes at least one fluid nozzle opening (18,19) having bounding ends in plan view, at least one of said bounding ends of said nozzle opening connecting substantially directly to an end wall (24) of a fluid chamber (17), said end wall (24) being traversed by a fluid chamber outlet (25), said nozzle opening (18,19) issuing into a narrowest gap portion of said fluid chamber (17) between deflector faces (23) and extending substantially up to said chamber outlet (25) to connect said nozzle opening (18) with said chamber outlet (25).

10. A sprinkler for irrigating an irrigation field by delivering at least one fluid jet from a point of final contact with said sprinkler (1), said fluid jet traveling over a median throw distance extending from said point of final contact with said sprinkler to a median point in an area of irrigation and said fluid jet defining a jet configuration at a given distance downstream of said point of final contact with said sprinkler and towards said area of irrigation, said sprinkler (1) comprising:

at least one sprinkler head (2) having a sprinkler head body, a fluid inlet (12) for receiving the fluid from a supply of pressurized fluid at a flow volume per time unit, a fluid outlet (11), and between said fluid inlet (12) and said fluid outlet (11), a fluid guide (13) for guiding at least one fluid flow stream, said fluid flow stream flowing in at least one flow direction; and control means (10) for varying the jet configuration substantially independently of the given supply pressure at said fluid inlet (12), said control means (10) including at least one functional member (33,34) for cycling back and forth between a first operating position and a second operating position to repeatedly modify the fluid flow in at least one operating zone with the sprinkler head body to produce a first jet configuration corresponding to said first operating position and to produce a second jet configuration corresponding to said second operating position, wherein said control means (10) are provided for modifying the fluid flow upstream of said point of final contact and said fluid outlet (11) to switch between the first and second jet configurations substantially independent of the fluid volume discharge per time unit.

11. A sprinkler for irrigating an irrigation field by delivering at least one fluid jet from a point of final contact with said sprinkler (1), said fluid jet traveling over a median throw distance extending from said point of final contact with said sprinkler to a median point in an area of irrigation and said fluid jet defining a jet configuration at a given distance downstream of said point of final contact with said sprinkler and towards said area of irrigation, said sprinkle (1) comprising:

at least one sprinkler head (2) having a sprinkler head body, a fluid inlet (12) for receiving the fluid from a supply of pressurized fluid at a flow volume per time unit, a fluid outlet (11), and between said fluid inlet (12) and said fluid outlet (11), a fluid guide (13) for guiding at least one fluid flow stream, said fluid flow stream flowing in at least one flow direction; and control means (10) for varying the jet configuration substantially independently of the given supply pressure at said fluid inlet (12), said control means (10) including at least one functional member (33,34) for cycling back and forth between a first operating position and a second operating position to repeatedly modify the fluid flow in at least one operating zone with the sprinkler head body to produce a first jet configuration corresponding to said first operating position and to produce a second jet configuration corresponding to said second operating position, wherein a connecting duct (26) is provided in said operating zone, said connecting duct (26) having a duct inlet (25) upstream of said fluid outlet (11), said duct inlet (25) being located in an end passage plane and having opposing first and second passage boundaries, said first passage boundary being provided by a projection (27) located substantially in said passage plane and projecting over a circumferential duct wall of said connecting duct (26) towards said second passage boundary.

* * * * *

UNITED STATES PATENT AND TRADEMARK OFFICE

CERTIFICATE OF CORRECTION

Patent No. : 5,611,488

Dated : March 18, 1997

Inventor : Hans Frölich

It is certified that error appears in the above-identified patent and that said Letters Patent is hereby corrected as shown below:

Col. 2, line 16, "Jet" should be --jet--.

Col. 8, line 53, "inter-secting" should be --intersecting--.

<u>In the Claims</u>:

Claim 11, line 22, "with" should be --within--.

Signed and Sealed this

Twenty-seventh Day of April, 1999

*Attest:*

Q. TODD DICKINSON

*Attesting Officer*

*Acting Commissioner of Patents and Trademarks*